United States Patent [19]

Sakamoto et al.

[11] Patent Number: 5,035,216

[45] Date of Patent: Jul. 30, 1991

[54] IDLING SPEED ADJUSTING SYSTEM FOR AN AUTOMOTIVE ENGINE

[75] Inventors: Masanori Sakamoto, Hamura; Masaharu Kubota, Musashino, both of Japan

[73] Assignee: Fuji Jukogyo Kabushiki Kaisha, Tokyo, Japan

[21] Appl. No.: 462,586

[22] Filed: Jan. 9, 1990

[30] Foreign Application Priority Data

Jan. 20, 1989 [JP] Japan ..... 1-12847

[51] Int. Cl.[5] ..... F02D 41/16

[52] U.S. Cl. ..... 123/339; 364/431.07

[58] Field of Search ..... 123/339, 335, 179 B, 123/585, 587; 364/431.07

[56] References Cited

U.S. PATENT DOCUMENTS

| | | | |
|---|---|---|---|
| 3,964,457 | 6/1976 | Coscia | 123/339 |
| 4,345,554 | 8/1982 | Hildreth et al. | 123/335 X |
| 4,501,240 | 2/1985 | Aono | 123/339 |
| 4,606,307 | 8/1986 | Cook | 123/179 B |
| 4,660,528 | 4/1987 | Buck | 123/335 X |
| 4,674,454 | 6/1987 | Phairr | 123/179 B |
| 4,819,596 | 4/1989 | Yasuoka et al. | 123/339 |
| 4,856,475 | 8/1989 | Shimomura et al. | 123/339 |
| 4,883,034 | 11/1989 | Yashiki et al. | 123/339 |
| 4,884,540 | 12/1989 | Kishimoto et al. | 123/339 |

FOREIGN PATENT DOCUMENTS 58-23237 2/1983 Japan .

*Primary Examiner*—Willis R. Wolfe

*Attorney, Agent, or Firm*—Martin A. Farber

[57] ABSTRACT

An idling speed control system is arranged such that idling speed of an automotive engine is controlled to a desired idling speed. The system has a memory for storing data for changing the desired idling speed. The data are applied by operating an outside instrument through a communication system. The desired idling speed is changed with the data stored in the memory, so that the predetermined idling speed is changed.

3 Claims, 10 Drawing Sheets

IDLING SPEED ADJUSTING SYSTEM FOR AN AUTOMOTIVE ENGINE

BACKGROUND OF THE INVENTION

The present invention relates to a system for adjusting or changing idling speed of an automtive engine in accordance with change of electrical installation of a motor vehicle.

In an electronically controlled engine having an electrical engine speed control system, an idling speed control valve is provided in a bypass of a throttle valve for controlling the engine speed during idling of the engine. The idling speed control valve is operated by control pulses to control the flow of air passing through the bypass. The engine speed control system is arranged so as to control the idling speed to a desired idling speed corresponding to a predetermined idling speed in accordance with a control program.

If electrical load is increased by additionally mounting electrical instruments such as lamps, the predetermined idling speed must be increased so as to increase the power of a generator mounted on the engine. In order to increase the predetermined idling speed, another control program and data are stored in a ROM. However, it is difficult for a user to change the program and data in the ROM.

SUMMARY OF THE INVENTION

The object of the present invention is to provide a system in which a predetermined idling speed may be easily changed without changing memories in an electric speed control system.

Other objects and features of this invention will become understood from the following description with reference to the accompanying drawings.

DETAILED DESCRIPTION OF THE PREFERRED EMBODIMENTS

Figure 1:
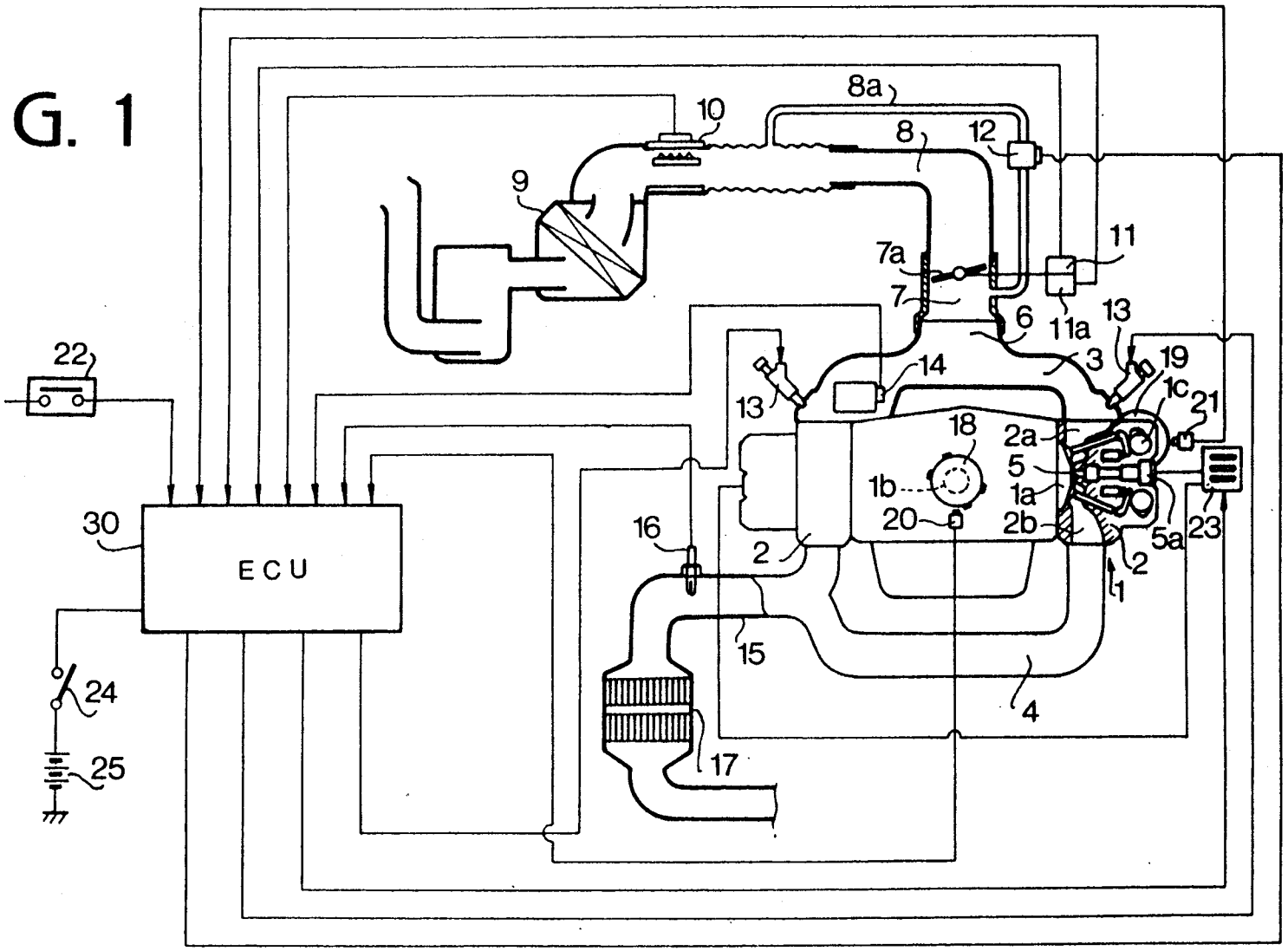
FIG. 1 is a schematic illustration of a system according to the present invention.

Referring to FIG. 1 showing a horizontal opposite type four-cylinder engine 1, each cylinder head 2 of the engine 1 has intake ports 2*a* and exhaust ports 2*b* which are communicated with an intake manifold 3 and an exhaust manifold 4, respectively. A spark plug 5 having an ignition coil 5*a* is located in each combustion chamber 1*a* formed in the cylinder head 2. A throttle chamber 7 having a throttle valve 7*a* is communicated with the intake manifold 3 through an air chamber 6. The throttle chamber 7 is communicated with an air cleaner 9 through an intake pipe 8. The intake pipe 8 has a bypass passage 8*a* around the throttle valve 7*a*, in which an idling speed control valve (ISCV) 12 is provided.

An intake air quantity sensor 10 (hot wire type airflow meter) is provided in the intake pipe 8 downstream of the air cleaner 9. a throttle position sensor 11 is provided for detecting the opening degree of the throttle valve 7*a*. An idling switch 11*a* is provided adjacent the throttle position sensor 11 for detecting the throttle valve 7*a* at an idling position. Fuel injectors 13 are provided in the intake manifold 3 adjacent every intake port 2*a*. A coolant temperature sensor 14 is provided in a coolant jacket (not shown) of the engine 1. A crankshaft disk 18 is secured to a crakshaft 1*b* of the engine 1. A crank angle sensor 20 (magnetic pickup) is provided adjacent the crankshaft disk 18. the crankshaft disk 18 has projections or notches representing crank angles. A camshaft disk 19 is secured to a camshaft 1*c* for detecting camshaft angles representing the number of the cylinder. A cam angle sensor 21 is provided adjacent the camshaft disk 19.

An $O_2$-sensor 16 and a catalytic converter 17 are provided in an exhaust passage 15 communicating with the exhaust manifold 4.

An electronic control unit (ECU) 30 having a microcomputer is provided for electronically controlling the engine. An input port of the ECU 30 is connected to the sensors 10, 11, 14, 16, 20 and 21, the idling switch 11*a* and an air conditioner switch 22. An output port of the ECU 30 is connected to the idling speed control valve 12, the fuel injectors 13 and an igniter 23 comprising transistors. The igniter 23 is connected to the ignition coil 5*a* to energize the coil 5*a* for igniting the spark plug 5 without a distributor. A battery 25 is connected to the ECU 30 through a key switch 24.

Figure 2:
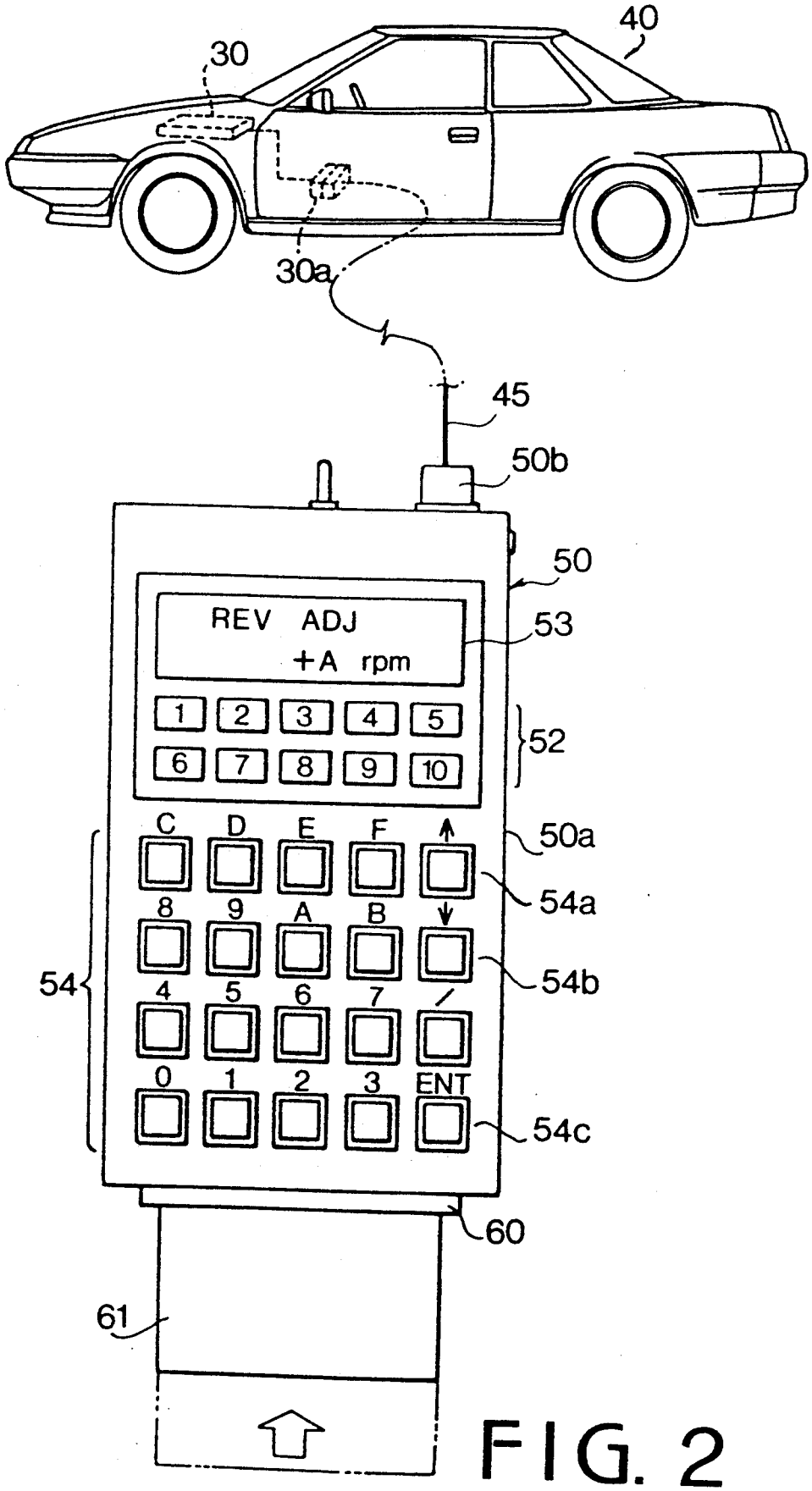
FIG. 2 is a schematic diagram showing a motor vehicle with a monitoring device of the system.

Referring to FIG. 2, an automobile 40 is equipped with the ECU 30 which is connected to an external connector 30*a*. A portable monitoring device 50 comprising a microcomputer is housed in a case 50*a* having a connector 50*b*, to which the connector 30*a* of the ECU 30 is connected through an adapter harness 45. The monitoring device 50 provided as equipment in an auto shop. A bidirectional communication system by serial transmission is provided between the ECU 30 and the monitoring device 50 for adjusting a desired idling speed of the engine and for diagnosing the ECU 30.

The monitoring and diagnostic device 50 has a liquid crystal display 53, an indicator section 52 consisting of a plurality of indicators of LED, and a keyboard 54. A connector 60 is provided for connecting a detachable memory cartridge 61.

Figure 3A:
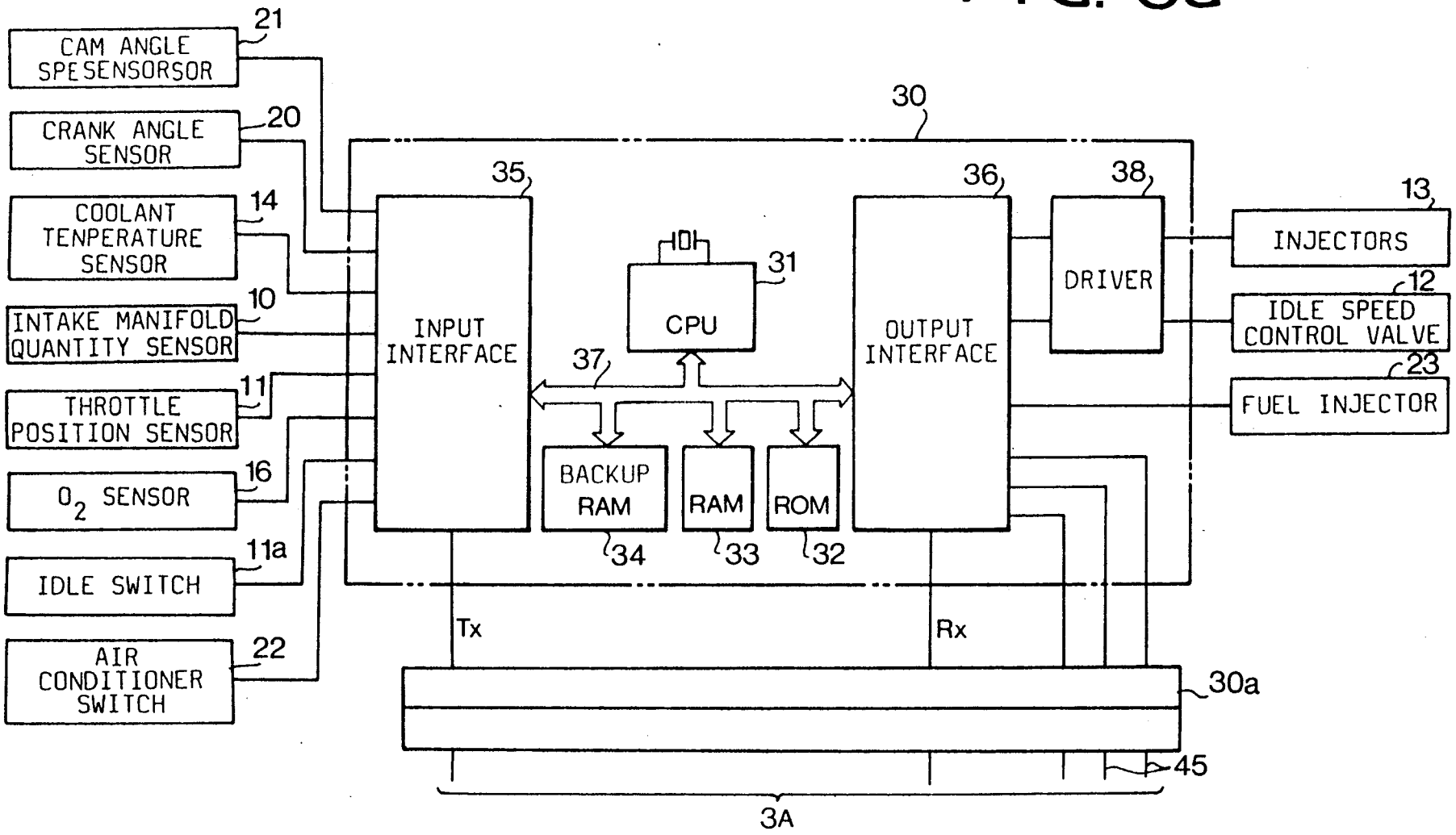
FIGS. 3*a* and 3*b* show a block diagram of the system.
Figure 3B:
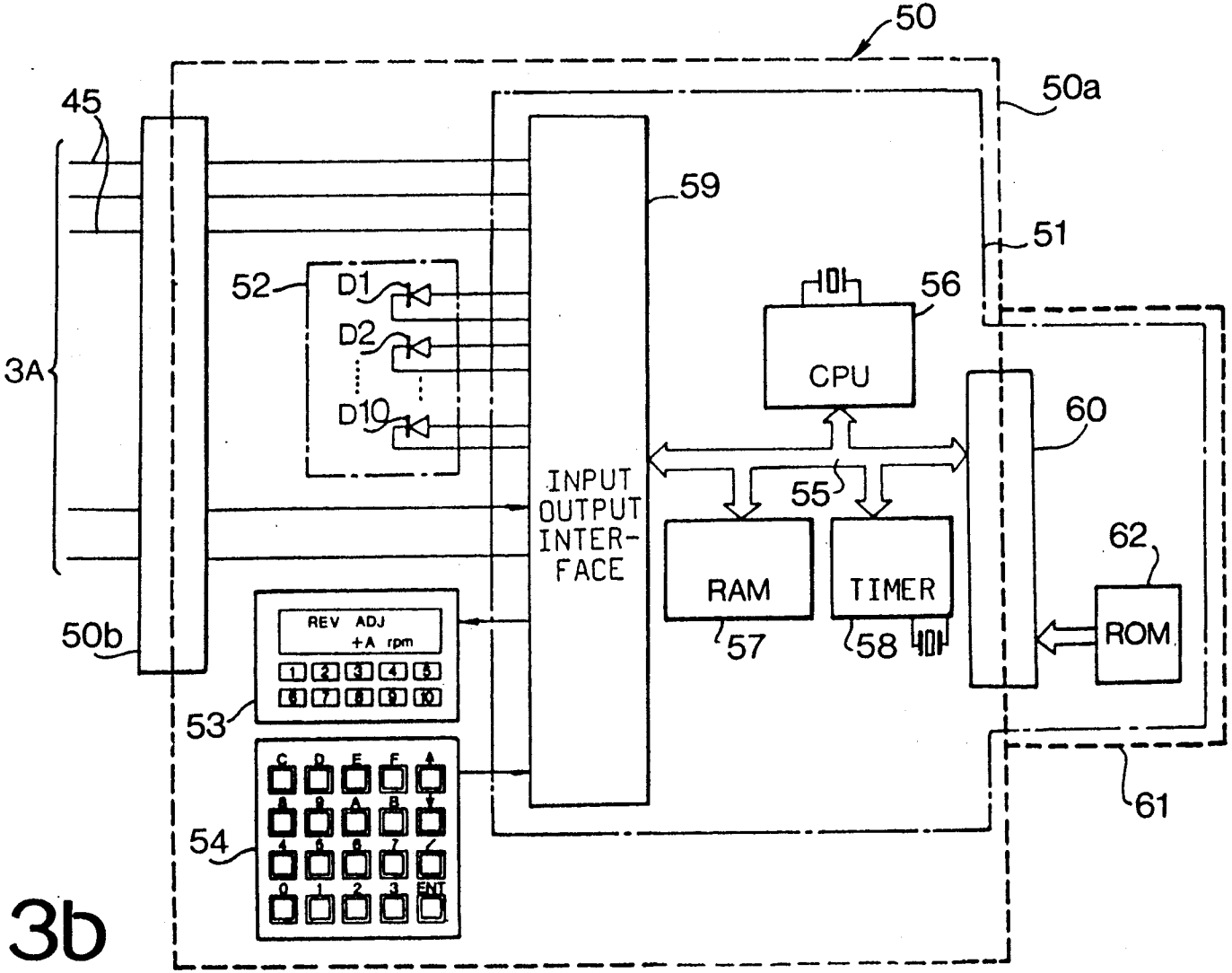

Referring to FIGS. 3*a* and 3*b*, the electronic control unit 30 comprises a central processor unit (CPU) 31, a read only memory (ROM) 32, a random access memory (RAM) 33, a backup random access memory (backup RAM) 34, an input interface 35 and an output interface 36. The CPU 31, ROM 32, RAMS 33 and 34, and input and output interfaces 35 and 36 are connected to each other through a bus line 37. Programs and fixed data for controlling the engine are stored in the ROM 32.

The input interface 35 is applied with signals from the intake manifold quantity sensor 10, throttle position sensor 11, coolant temperature sensor 14, $O_2$ sensor 16, crank angle sensor 20, cam angle sensor 21, idle switch 11*a* and air conditioner switch 22.

These signals are stored in the RAM 33 as driving condition parameters after processing data. The CPU 31 calculates a quantity of fuel injection, an ignition timing, and a control value of the engine speed at idling based on the parameters stored in the RAM 33 in accordance with the control program stored in the ROM 32. The CPU produces respective control signals, which are applied to the driver 38 through the output interface 36. The driver 38 produces signals for controlling the fuel injectors 13, idling speed control valve 12 and igniter 23.

The monitoring and diagnostic device 50 has a control unit 51. The control unit 51 comprises a CPU 56, a RAM 57, an input/output (I/O) interface 59, and a timer 58. These elements are connected to each other through a bus line 55. The I/O interface 59 is connected to the input and output interfaces 35 and 36 of the ECU 30 through the connectors 30*a* and 50*b* and the harness 45 so as to supply a signal TX to the ECU 30 and to receive a signal RX from the ECU 30. An input of the I/O interface 59 is connected to the keyboard 54. Outputs of the interface 59 are connected to the indicator section 52 and the display 53. The indicator section 52 has a plurality of LEDs $D_1$ to $D_{10}$ which are operated through switches of the ECU 30.

The I/O interface 59 receives output signals of the sensors and switches in the ECU 30 through the output interface 36. The received data is displayed on the display 53. When one of the switches is turned on, a corresponding LED of LEDs $D_1$ to $D_{10}$ is lighted or intermittently lighted, so that the operation of the switch can be confirmed.

The memory cartridge 61 compatibly matching the type of the control program of the ECU 30 is connected to the monitoring device 50 through the connector 60. A ROM 62 provided in the memory cartridge 61 stores programs for communication between the ECU 30 and the monitoring device 50 and fixed data.

Figure 4A:
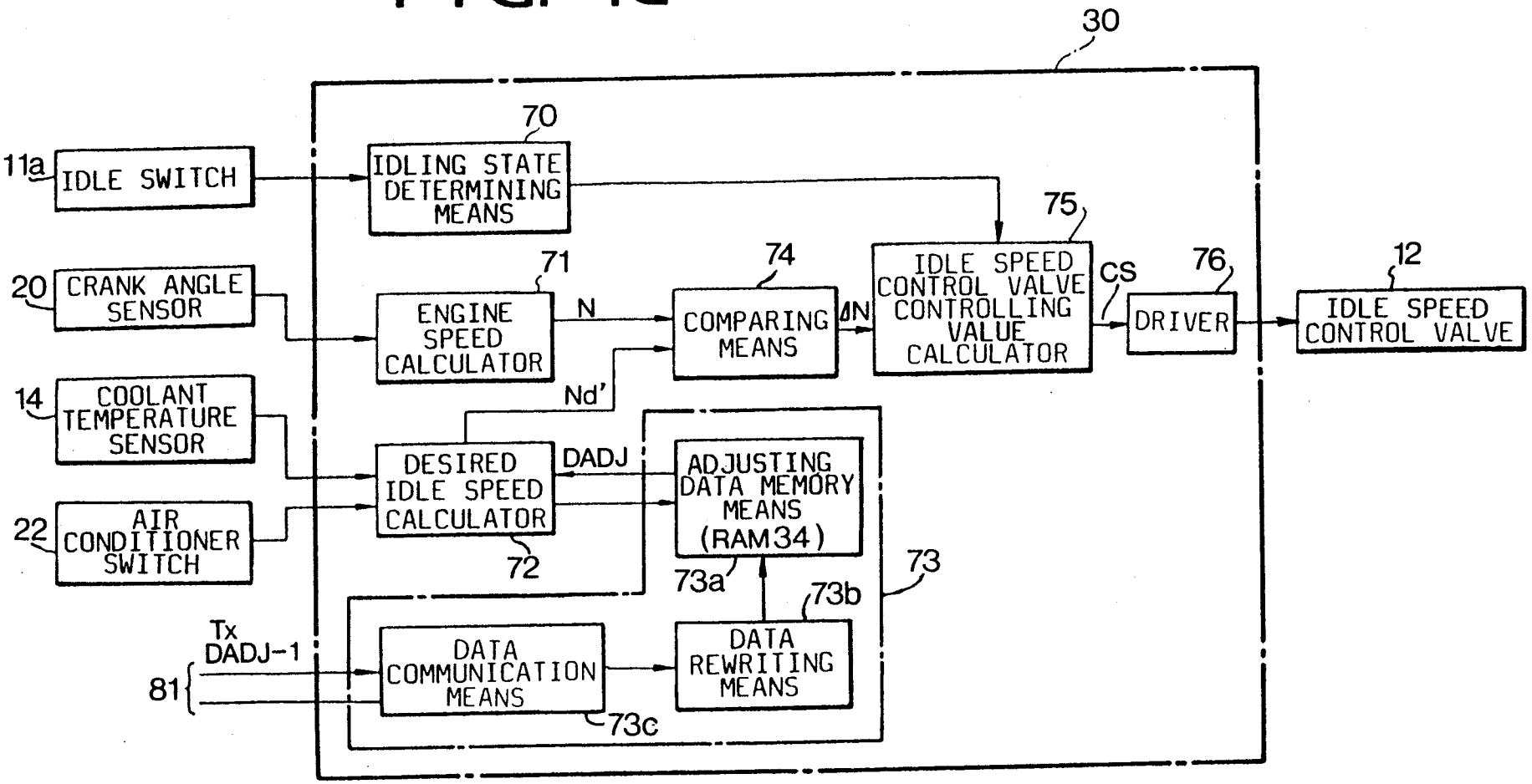
FIGS. 4*a* and 4*b* show a functional block diagram of the system.
Figure 4B:
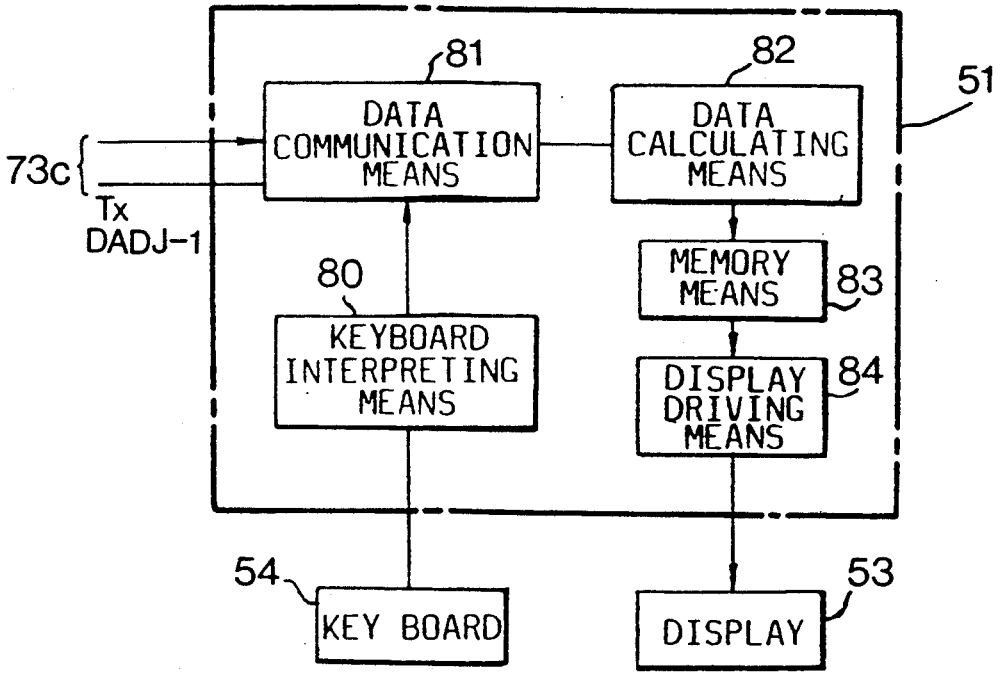

Referring to FIG. 4, the ECU 30 has an idling state determining means 70 for determining the idling state of the engine 1 in accordance with a signal from the idling switch 11*a*. The idling switch 11*a* is adapted to be turned on when an accelerator pedal is released to position the throttle valve 7*a* at the idling position and produces an ON-signal which is applied to the idling state determining means 70. When the idling state is detected, the idling state determining means 70 produces a signal which is applied to a calculator 75 for calculating a control value of an idling speed control valve.

An engine speed calculator 71 is provided for calculating engine speed N based on a signal from the crank angle sensor 20. The engine speed N is applied to a comparing means 74. A desired idling speed calculator 72 including a data table storing a plurality of desired idling speeds is applied with output signals from the coolant temperature sensor 14 and the air conditioner switch 22 and determines desired idling speed Nd in accordance with these signals. The desired idling speed Nd is a value for controlling the idling speed NI to a predetermined idling speed at the present condition of the engine (for example 650 rpm and 850 rpm when the air conditioner switch 22 is on).

Further, the ECU 30 has an idling speed adjusting means 73 for adjusting the desired engine idling speed Nd in the desired idling speed calculator 72. The idling speed adjusting means 73 has an adjusting data memory means 73*a* comprising the backup RAM 34 for storing a desired engine speed adjusting data DADJ. A data communication means 73*c* is provided for receiving a data demand signal from the monitoring device 50 and for transmitting a data signal to the monitoring device 50. A data rewriting means 73*b* is provided for rewriting the adjusting data DADJ stored in the memory means 73*a* in accordance with a signal from the data communication means 73*c*. The adjusting data DADJ is applied to the desired idling speed calculator 72 in which the adjusting data DADJ is added to or subtracted from the desired idling speed Nd or for obtaining a new desired idling speed Nd' which is applied to the comparing means 74.

The comparing means 74 compares the engine speed N from the engine speed calculator 71 with the desired idling speed Nd' from the desired idling speed calculator 72 and obtains the difference ΔN which is applied to the idling speed control valve controlling value calculator 75. The calculator 75 calculates a duty ratio D of control pulses based on the difference ΔN for controlling the idling speed control valve 12, that is the ratio of the opening period of the idling speed control valve 12 to a predetermined period. A control pulse signal CS having the duty ratio D is applied to the driver 76 for operating the idling speed control valve 12. Thus, the idling speed control valve 12 is operated to control the quantity of air passing through the bypass 8*a* for maintaining the idling speed NI at the desired idling speed Nd'.

In order to change the desired idling speed Nd to a preferable idling speed, the adjusting data DADJ in the adjusting data memory means 73 is corrected by manually operating the monitoring device 50 connected to the ECU 30. The data communication means 73*c* interprets a data demand signal TX and a new adjusting data DADJN fed from the monitoring device 50. The means 73*c* produces a rewriting command signal and the new adjusting data DADJN which is applied to the data rewriting means 73*b*. The data rewriting means 73*b* operates to rewrite the adjusting data DADJ stored in the adjusting data memory means 73*a* with the new adjusting data DADJN. Accordingly, the new adjusting data DADJN is used for correcting the desired idling speed Nd to new idling speed Nd'72.

The control unit 51 of the monitoring device 50 comprises a keyboard interpreting means 80 provided for interpreting a function and a command input by the keyboard 54. A data communication means 81 produces the data demand signal TX which is applied to the ECU 30 and receives the data signal RX fed from the ECU 30. A data calculating means 82 calculates the data received at the data communication means 81 for converting the received binary digit into decimal digits. A memory means 83 comprises a predetermined address of the RAM 57 for the display 53 and stores the calculated data. A display driving means 84 produces a signal in accordance with the calculated data stored in the memory means 83 for driving the display 53.

Figure 5A:
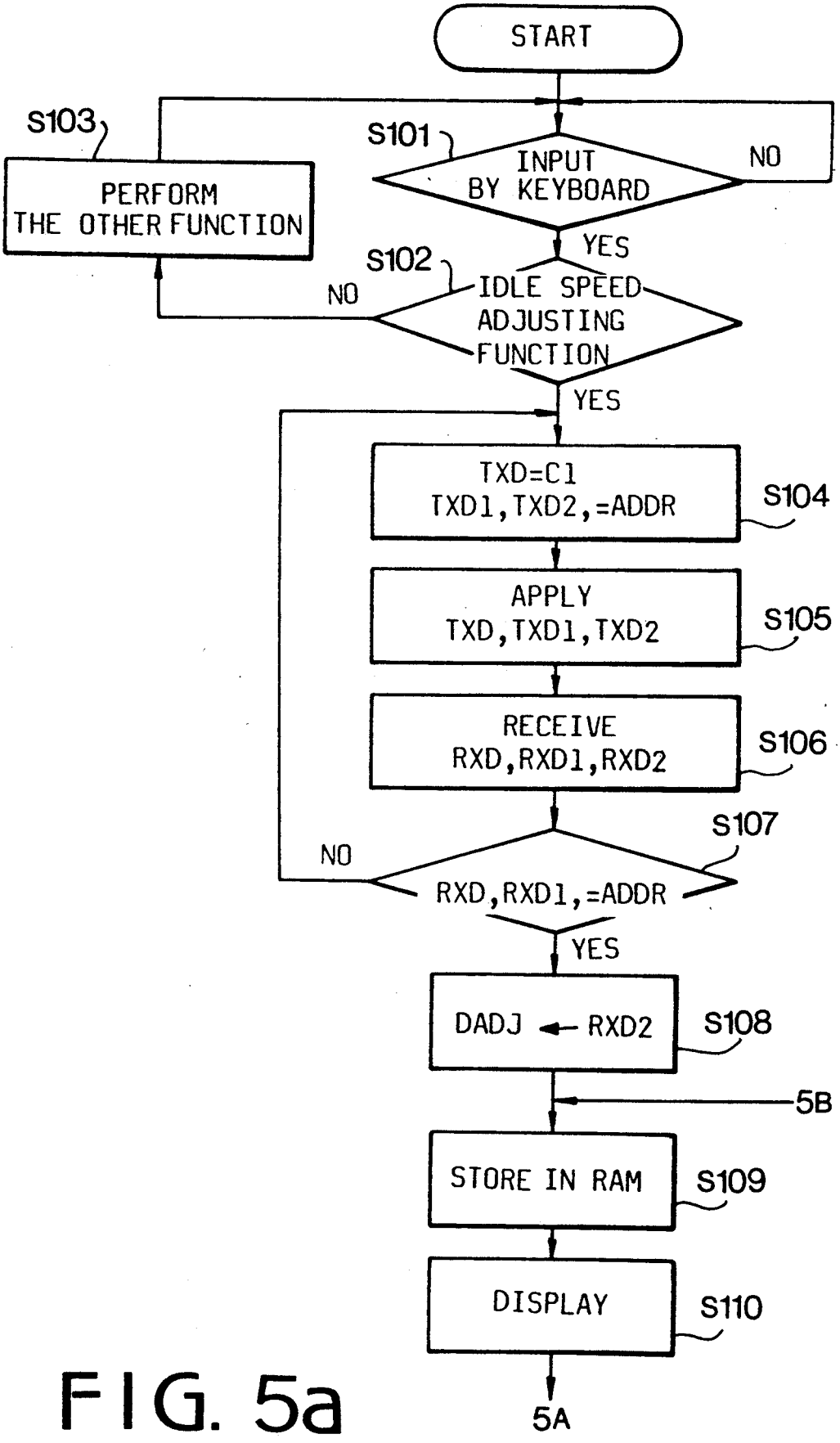
FIGS. 5*a* to 5*c* are flowcharts showing the operation of the monitoring device in the system.
Figure 5B:
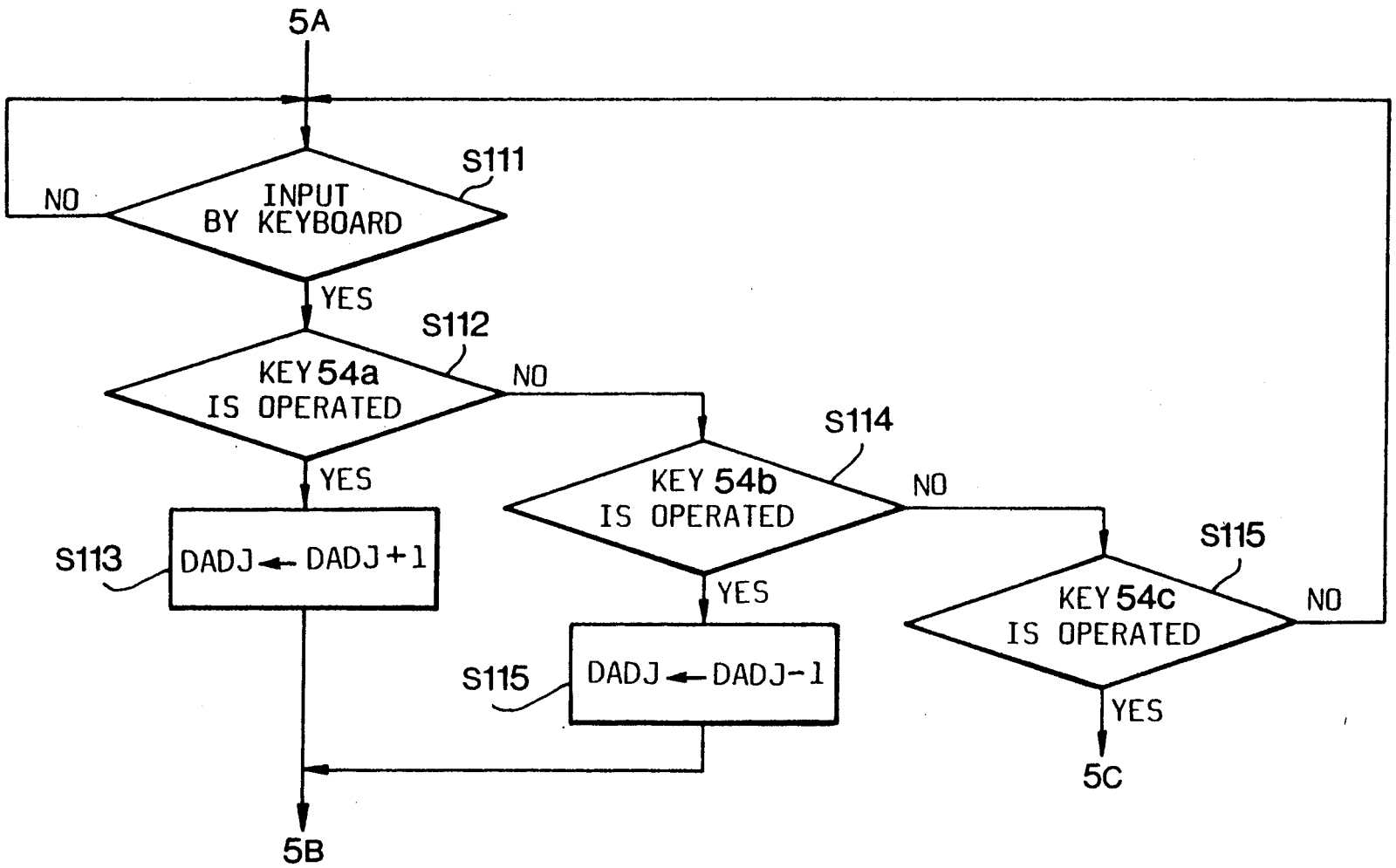
Figure 5C:
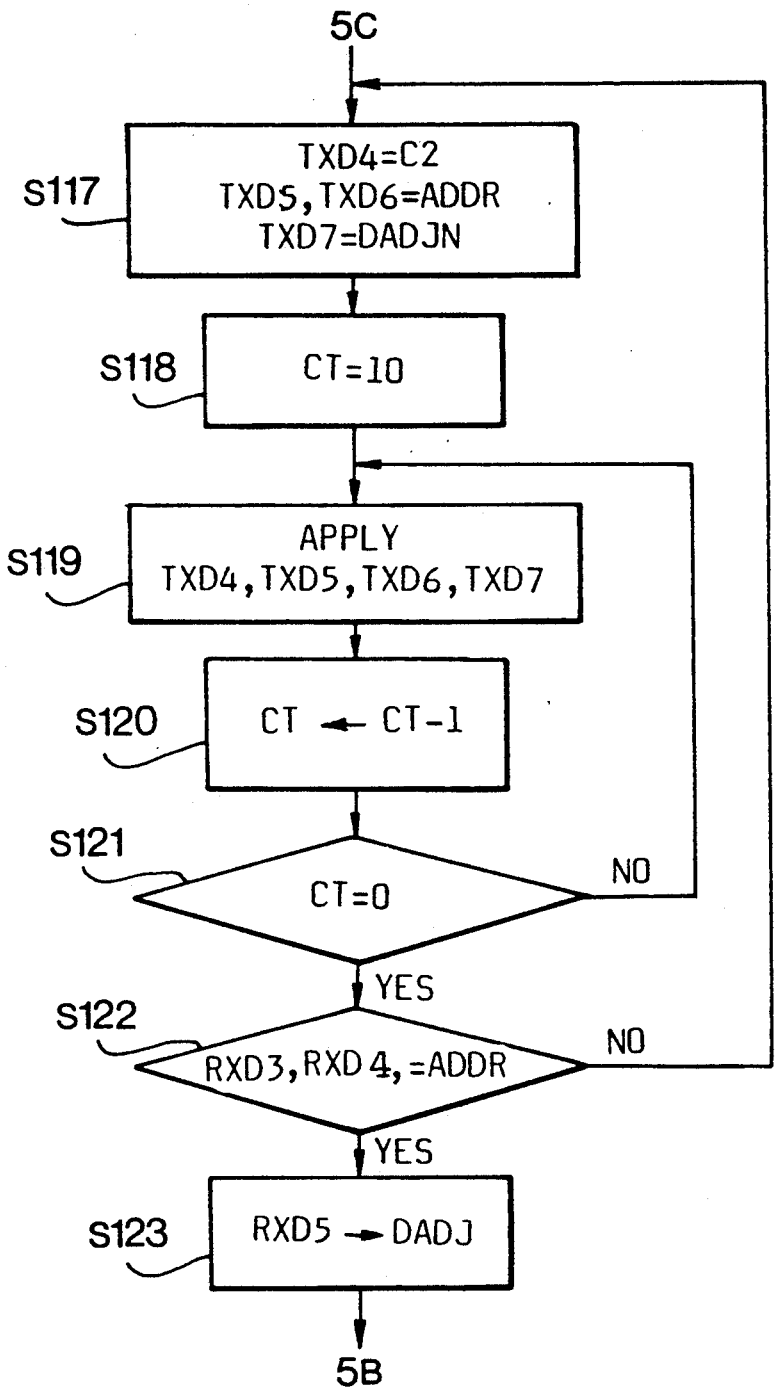

The operation of the monitoring device 50 is described hereinafter with reference to the flowchart of FIGS. 5*a* to 5*c*.

At a step S101, it is determined in the keyboard interpreting means 80 whether an input is performed by the keyboard 54 or not. If the input is determined, the program goes to a step S102 where the content of the input is interpreted. It is determined whether the input relates to an idling speed adjusting function or not. If the input is a demand for performing the other function, the program proceeds to a step S103 for performing the function and returns to the step S101.

If the idling speed adjusting function is determined, the program goes to a step S104. At the step S104, a data demanding command C1 for demanding the present adjusting data DADJ, high and low addresses of a storing ADDR for the adjusting data are set to data demand signals TXD, TXD1 and TXD2, respectively, which are applied to the data communication means 81.

At a step S105, data demand signals TXD, TXD1 and TXD2 are applied from the data communication means 81 to the ECU 30 in order.

At a step S106, data signals RXD and RXD1 representing addresses and a data signal RXD2 representing the adjusting data from the ECU 30 corresponding to the data demand signals are received in the data communication means 81. At a step S107, it is determined whether the data signals RXD and RXD1 correspond to the address ADDR for the adjusting data DADJ or not in the data calculating means 82. If the data signal RXD and RXD1 differ from ADDR, the program returns to the step S104 to repeat the program. If the data signals correspond to the address ADDR, the program goes to a step S108 where the received binary digits of the data signal RXD2 representing the adjusting data DADJ is converted into a decimal digits. At a step S109, the data is stored in the memory means 83. At a step 110, the driving means 84 produces a calculated data stored in the memory means 83 which is applied to the display 53. A numerical value A of the present adjusting data DADJ, the function REV ADJ and the unit rpm are displayed on the display 53 as shown in FIG. 2.

At a step S111, an input by the keyboard 54 is again determined. If the input is determined, the program proceeds to a step S112 where it is determined whether a data increasing key 54*a* of the keyboard 54 (FIG. 2) is operated or not. If the key 54*a* is operated, the program proceeds to a step S113 where 1 is added to the present adjusting data DADJ, and the program returns to the step S109.

If the key 54*a* is not operated at the step S112, the program proceeds to a step S114 where it is determined whether a data decreasing key 54*b* (FIG. 2) is operated or not. If the key 54*b* is operated, the program goes to a step S115 where 1 is subtrated from the adjusting data DADJ and the program returns to the step S109. The operation at the step S113 or step S115 is repeated until the adjusting data DADJ reaches a preferable value. If the key 54*b* is not operated at the step S114, the program goes to a step S116 where it is determined whether a rewriting key 54*c* (FIG. 2) is operated or not. If the key 54*c* is not operated, the program returns to the step S111. If the key 54*c* is operated, a demand for rewriting the adjusting data is determined and a value for a new adjusting data DADJN is set and the program goes to a step S117.

In the system, since the adjusting data DADJ is corrected by operating keys 54*a* and 54*b*, it is possible to increase or decrease the data without inputting numbers by operating the keyboard 54.

At the step S117, a data rewriting command C2, high and low addresses of the storing ADDR for the adjusting data, and the new adjusting data DADJN are set to data demand signals TXD4, TXD5, TXD6 and TXD7, which are applied to the data communication means 81. At a step S118, a counter CT is set to a predetermined value such as ten. At a step S119, data demand signals are applied from the data communication means 81 to the ECU 30. At a step S120, 1 is subtracted from the counter CT. At a step S121, it is determined whether the counter CT becomes zero or not, that is a predetermined number of the data transmission is performed or not. If the counter CT becomes zero, it is determined that the data transmission is terminated and the program goes to a step S122. If the counter is not zero, the program returns to the step S119 to continue transmitting the data.

At a step S122, the data communication means 81 receives data signals RXD3 and RXD4 representing addresses and a signal RXD5 representing the adjusting data demanded to be rewritten and applied from the ECU 30 data corresponding to data demand signals. It is determined whether data signals RXD3 and RXD4 correspond to the address ADDR for the adjusting data DADJ to be rewritten or not in the data calculating means 82. If the data signals RXD3 and RXD4 differ from ADDR, the program returns to the step S117 to repeat the program. If the data signals correspond to the address ADDR, the program goes to a step S123 where the received binary digits of the data signal RXD5 representing the adjusting data DADJN is converted into decimal digits and the program returns to the step S109. A value of a rewritten adjusting data DADJN is displayed on eh display 53.

Figure 6:
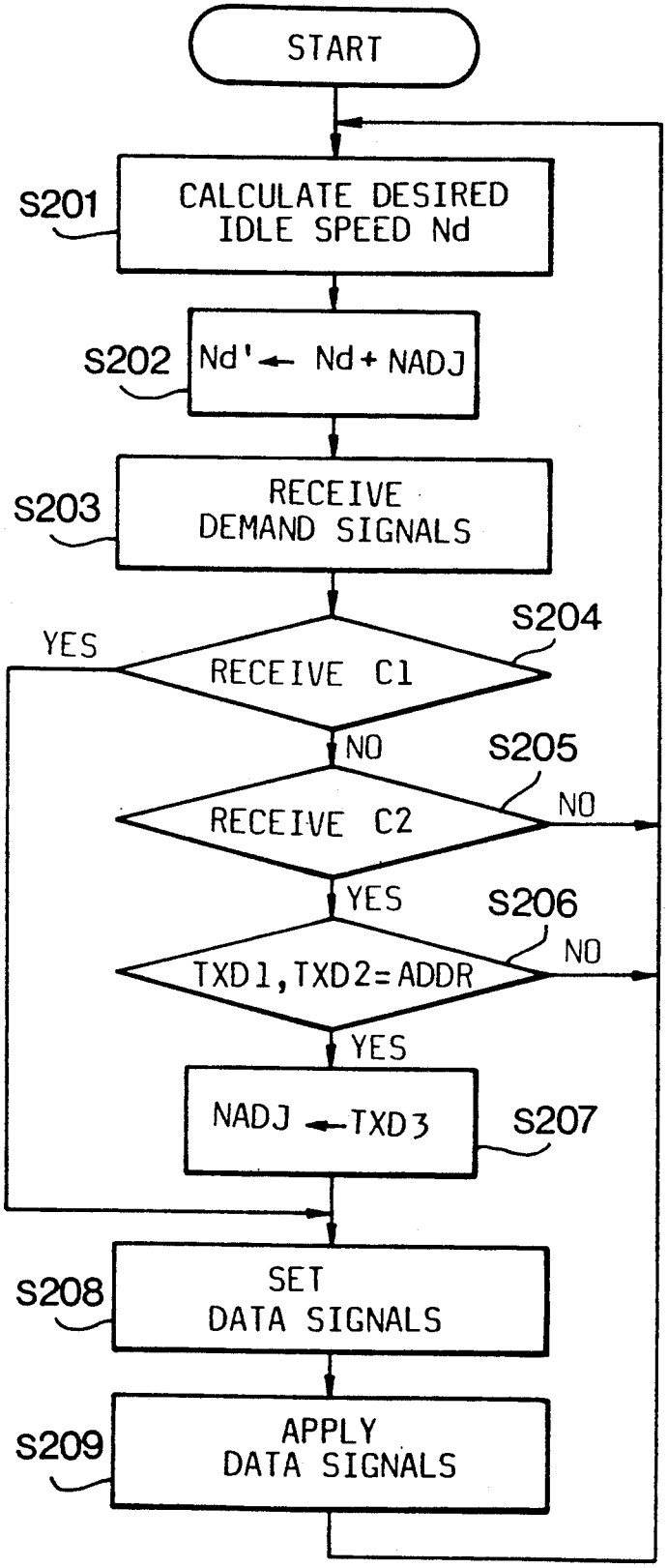
FIG. 6 is a flowchart showing the operation of an electronic control unit of the system.

The operation of the ECU 30 for rewriting the adjusting data will be described hereinafter with reference to the flowchart of FIG. 6.

At a step S201, the desired idling speed Nd at the idling state is calculated in the desired idling speed calculator 72 in accordance with signals from the coolant temperature sensor 14 and the air conditioner switch 22. At a step S202, the adjusting data DADJ stored in the adjusting data memory means 73*a* is added to the desired idling speed Nd to obtain the desired idling speed Nd' for controlling the idling speed NI.

At a step S203, the data communication means 73*c* receives the data demand signals TXD, TXD1, TXD2 and TXD3 or signals TXD4, TXD5, TXD6 and TXD7 from the monitoring device 50. At a step S204, it is determined whether the data demand signal TXD corresponding to the demanding command C1 is received or not. If the data demanding command C1 is determined, the program proceeds to a step S208. If not, the program proceeds to a step S205 where it is determined whether the data demand signal TXD4 corresponding to the rewriting command C2 is received or not. If the command C2 is received, the program goes to a step S206. If not, the program returns to the step S201.

At the step S206, it is detemined whether the data demand signals TXD5 and TXD6 correspond to the address ADDR of the backup RAM 34 storing the adjusting data DADJ or not. If it is determined that signals TXD4 and TXD5 correspond to the address ADDR, the program proceeds to a step S207. If signals TXD4 and TXD5 differ from the ADDR, the program returns to the step S201.

At the step S207, the adjusting data DADJ is rewritten with the data in the data demand signal TXD3. At the step S208, addresses ADDR and a rewritten adjusting data DADJN are set to data signals RXD, RXD1 and RXD2 or signals RXD3, RXD4 and RXD5. At a step S209, data signals are applied to the monitoring device 50. When the data transmission is terminated, the program is repeated.

In the above described embodiment, a plurality of adjusting data may be provided with respect to the variation of the engin conditions, for example the state of the air conditioner switch 22. In this case, the adjusting data are rewritten independently, so that it is possible to improve precision of the adjusting operation of the adjusting data by the monitoring device.

From the foregoing it will be understood that the present invention provides an idling speed control system in which data for adjusting the idling speed can be changed by operating an outside instrument without changing the memory.

While the presently preferred embodiment of the present invention has been shown and described it is to be understood that this disclosure is for the purpose of illustration and that various changes and modificaitons may be made without departing from the scope of the invention as set forth in the appended claims.

What is claimed is:

1. an idling speed adjusting system for an automotive engine having an actuator provided to control an idling speed and a control unit including detecting means for producing an actual engine speed signal dependent on an engine speed, sensing means for producing engine operating condition signals dependent on engine operating conditions, setting means responsive to the engine operating condition signals for determining a desired idling speed, and control means for calculating a control value for the actuator in accordance with a difference between the actual engine speed and the desired idling speed, so as to maintain the idling speed of the desired idling speed, the improvement of the system comprising:

memory means provided in the control unit for storing adjusting data to correct the desired idling speed;

rewriting means provided in the control unit for rewriting the adjusting data;

an outside instrument provided to commant the rewriting means to rewrite the adjusting data;

connecting means provided to connect the outside instrument to the control unit; and said setting means for correcting the desired idling speed with the adjusting data.

2. The outside instrument of the system according to claim further comprising:

a keyboard for manually inputting the function and data for rewriting the adjusting data;

interpreting means for interpreting a content of the function and the data of rewriting the adjusting data;

communication means for applying a data demand signal representing the content of the input to the control unit through the connecting means and receiving the present adjusting data from the control unit;

calculating means for converting the received present adjusting data from a binary digit to a decimal digit; and display means for displaying said decimal adjusting data.

3. The outside instrument of the system according to claim 2, wherein said communication means applies a first signal for demanding to transmit the present adjusting data and a second signal for demanding to rewrite the present adjusting data to the control unit.

* * * * *